US005540214A

United States Patent [19]

Boudreault

[11] Patent Number: 5,540,214

[45] Date of Patent: Jul. 30, 1996

[54] EXHAUST HOOD

[76] Inventor: Jean-Pierre Boudreault, 4232 Moïse Picard, Montréal, P.Q., Canada, H1X 3M1

[21] Appl. No.: 444,024

[22] Filed: May 18, 1995

[51] Int. Cl.[6] ..... F24C 15/20

[52] U.S. Cl. ..... 126/299 E; 126/299 R; 55/242; 55/436; 55/DIG. 36

[58] Field of Search ..... 126/299 R, 299 D, 126/299 E, 301; 55/DIG. 36, 242, 436, 442–444

[56] References Cited

U.S. PATENT DOCUMENTS

| | | | |
|---|---|---|---|
| 2,081,640 | 8/1936 | Peterson . | |
| 2,532,420 | 6/1945 | Pledger . | |
| 3,055,285 | 9/1962 | Gaylord . | |
| 3,893,831 | 7/1975 | Doane | 126/299 E |
| 4,071,019 | 1/1978 | King | 126/299 E |
| 4,266,529 | 5/1981 | Gaylord | 126/299 D |
| 4,281,635 | 8/1981 | Gaylord . | |
| 4,822,385 | 4/1989 | Strege et al. . | |

*Primary Examiner*—James C. Yeung

[57] ABSTRACT

Along the path of the cooking fumes of an exhaust hood where the fumes move with swirling motion, forwardly adjustable blades are disposed between a retracted and an extended position to accentuate or decrease the intensity of the swirling path end of the centrifugal force applied to the particles to be removed, depending on the volume and the flow rate of the cooking fumes which ascend through the hood. This blade arrangement also ensures a constant static pressure inside the hood for a maximum efficiency of extraction.

12 Claims, 2 Drawing Sheets

EXHAUST HOOD

BACKGROUND OF INVENTION (a) Field of the Invention

The present invention relates to an exhaust hood. More particularly, the invention is concerned with a hood which is used to separate grease particles contained in cooking fumes produced when cooking over a cooking unit, the fumes being directed towards the hood. The exhaust hood according to the invention is particularly interesting in that the swirling motion of the path of cooking fumes can be adjusted depending on the volume and the velocity of the fumes to be exhausted and which may contain various amounts of grease particles.

(b) Description of Prior Art

In a commercial kitchen, such as in a restaurant where the cooking units produce considerable quantities of fumes loaded with smoke, grease particles, moisture and the like, it is necessary to provide hoods over them which will return gases to the outside air which are as free as possible from undesired material. Now, since these systems must be efficient, they naturally consume a lot of energy. Moreover, since all these cooking units do not necessarily produce the same quantities of cooking fumes, it would be of interest to be able to rely on devices which consume no unnecessary energy to treat different types of fumes.

Ideally, commercial hoods induce some swirling of the flow of cooking fumes thereby trapping some of the impurities and undesired materials present therein through the action of centrifugal force which so to speak throws the impurities and undesired materials out of the path of the ascending fumes onto some traps or the walls disposed along the path of the fumes. However, due to the need to provide a very efficient system, the present exhaust hoods are often more sophisticated and energy consuming than is really needed. In reality, one selects a particular exhaust hood available on the market and has to live with it, even though in many cases it might be more performing than it is really needed.

In many types of hoods, the exhaust fan may be adjusted to cause a variation in the amount of suction it provides depending on the quantity of fumes produced and the amounts of impurities contained therein, thereby saving energy. Also, it is know that centrifugal force is responsible for causing the separation of grease particles and other impurities. Sometimes, when the volume of cooking fumes is not too important and the suction force provided by the fan is consequently not great, the swirling motion provided to the path of cooking fumes is not sufficient to rid the cooking fumes of a substantial part of its grease particles, impurities and other undesired materials. The only solution is to accelerate the speed of the fan, which is energy consuming and therefore undesirable. In other cases, if the suction applied is at a maximum, a desired swirling consequently follows and it is then unnecessary to provide additional means along the path to cause more swirling.

In addition, in order to operate a grease extracting hood economically and with good yield and maximum efficiency, it would be desirable to maintain a constant static pressure inside the hood.

The prior is loaded with references teaching various ways of producing a flow of cooking fumes which intend to remove as much undesirable materials as possible. In this connection, the following references should be noted:

U.S. Pat. No. 4,822,385
U.S. Pat. No. 4,281,635
U.S. Pat. No. 4,266,529
U.S. Pat. No. 4,071,019
U.S. Pat. No. 3,893,831
U.S. Pat. No. 3,055,285
U.S. Pat. No. 2,532,420
U.S. Pat. No. 2,081,640.

However, none of these references, teach the possibility of treating different volumes and flow rates of ascending cooking fumes to be exhausted.

SUMMARY OF INVENTION

It is therefore an object of the present invention to provide an exhaust hood which is capable of exhausting fumes at different volumes and rates of flow without having to spend an unnecessary amount of energy.

It is another object of the present invention to exhaust a flow of cooking fumes by inducing therein a variation of the swirling motion imparted thereto.

It is another object of the present invention to provide an exhaust hood which enables to maintain a constant static pressure therein, thereby ensuring a constant centrifugal effect and a maximum extraction or degreasing.

It is another object of the present invention to provide an exhaust hood with adjustable blades which create a more or less pronounced swirling of the flow of ascending cooking fumes, thereby increasing or decreasing the amount of centrifugal force imparted to the materials intended to be removed therefrom.

These and other objects of the present invention may be achieved in an exhaust hood which is adapted for separating grease particles and impurities contained in cooking fumes which are produced when cooking over a cooking unit wherein the cooking fumes are directed towards the hood. Such a hood includes vertical back, side and front walls, and a horizontal top wall, and an exhaust fan to direct the fumes substantially free of grease particles and other impurities, outside the hood through a vent. The exhaust hood according to the invention comprises means defining an upwardly directed swirling path for the cooking fumes thereby inducing centrifugal force in a flow of the cooking fumes and removing grease particles and other impurities from the cooking fumes, means permitting the removed grease particles and other impurities to drop in counter-current to the upwardly directed swirling path to be collected in the lower part of the hood, and a plurality of forwardly adjustable blade means disposed along the path to maintain a constant static pressure therein and accentuate or decrease the intensity of the swirling path and thereby of the centrifugal force applied to the grease particles and other impurities depending on the volume and flow rate of the cooking fumes ascending through the hood.

In accordance with a preferred embodiment of the invention, the exhaust hood comprises means defining an upwardly inclined inlet deflector at the entrance of the flow of cooking fumes into the hood.

In accordance with another preferred embodiment, the exhaust hood also comprises means defining a downwardly inclined internal deflector upwardly spaced from the inlet deflector.

Preferably, a transverse plate is mounted on the internal deflector and extends therefrom into the path of the cooking fumes to arrest some grease particles and other impurities and to impart an additional swirling movement to the path around its outer edge.

In accordance with another preferred embodiment, the exhaust hood comprises a manifold provided at the outer edge of the transverse plate, the manifold having cleaning jets mounted thereon to remove grease particles and other impurities remaining accumulated on the blade means, transverse plate and deflectors, by projecting a cleaning fluid thereon.

Preferably, the manifold has a rectangular cross-section and is mounted at the outer edge of the transverse plate through a corner of the manifold.

The transverse plate is preferably formed with a longitudinal flange at the inner edge thereof, and is mounted on the internal deflector through the flange. Normally the transverse plate is mounted at right angle with respect to the internal deflector.

In accordance with another preferred embodiment, the exhaust hood comprises a plate like lower grease particles and impurities collector, having an inner end fixed against the lateral wall and projecting substantially perpendicularly therefrom, the lower collector having an outer end, the upwardly inclined inlet deflector starting from the outer end of the lower grease particles and impurities collector and extending upwardly to an upward edge thereof providing a first swirling motion of the path.

Preferably, a drain is provided in the lower collector to drain away grease particles and impurities accumulated thereon.

In accordance with another preferred embodiment of the invention, the exhaust hood comprises a rectangular intermediate grease particles and impurities collector mounted on the lateral wall and projecting perpendicularly therefrom to its outer limit, a path opening formed in the intermediate collector to permit grease particles and impurities accumulated thereon to drop onto the lower grease particles and impurity collector and enabling the path to pass upwardly while swirling around a lower extremity of the intermediate deflector.

The lower extremity of the internal deflector is preferably fixed at the outer limit of the intermediate grease particles and impurities collector and the upper extremity of the internal deflector is mounted at the horizontal top wall of the exhaust hood. Preferably, the path opening formed in the intermediate collector extends from the lateral wall to the outer limit of the intermediate collector.

A removable door may be mounted in the internal deflector, to permit access inside the hood for cleaning or servicing same.

Preferably, there is a lower forwardly adjustable blade means disposed below the transverse plate and an upper forwardly adjustable means above the transverse plate. For example, the forwardly adjustable blade means may each be formed of a fixed panel secured to the lateral wall, and an adjustable panel is mounted on the fixed panel between a retracted and an extended position.

The lower blade means is normally mounted substantially horizontally and the upper blade means is usually downwardly inclined.

Bolts and nuts may be provided with the fixed panels, in which case the adjustable panel has longitudinal channels provided transversely with respect to the fixed panel and a plurality of finger like recesses perpendicular to the channels and all disposed on the same side of the channels, the bolts being disposed in selected recesses depending on the desired forward extent of the forward edge of the adjustable panel, displacement of the adjustable panel being facilitated by disengaging the bolts and thereafter engaging them in selected recesses.

BRIEF DESCRIPTION OF DRAWINGS

The invention will now be illustrated by means of the annexed drawings which are given only for the purpose of illustration but without any intention of limiting the scope of the invention, in the drawings, which illustrate the invention.

DESCRIPTION OF PREFERRED EMBODIMENT

Figure 1:
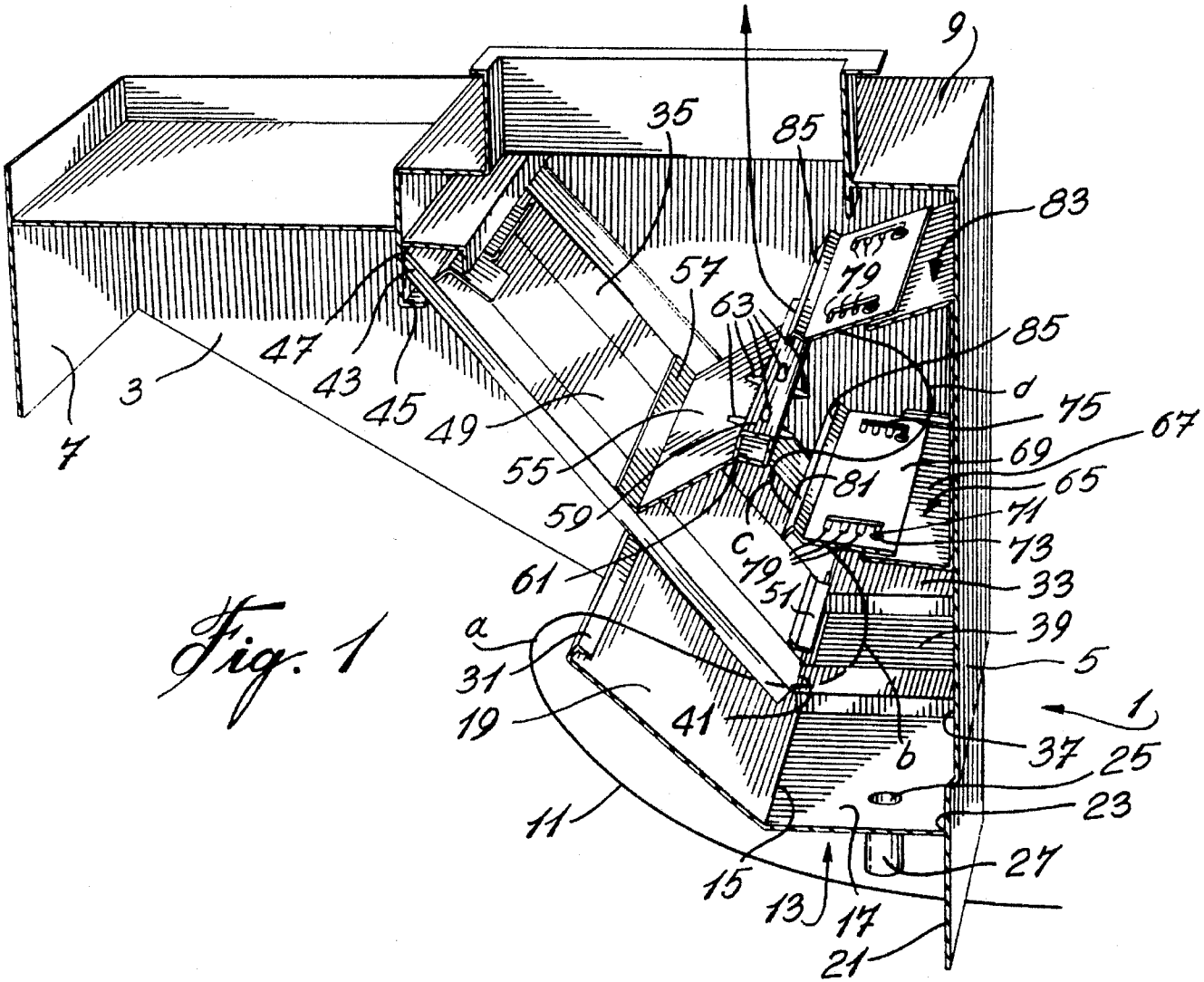
FIG. 1 is a perspective view of a single exhaust hood according to the invention with part being removed for a better understanding.

With reference to the drawings, it will be seen that an exhaust hood 1 according to the invention includes a vertical back wall 3, a vertical lateral wall 5, a short vertical lateral wall 7 and a horizontal top wall 9. The exhaust hood 1 also includes, in known manner, an exhaust fan (not shown) of known construction, to direct fumes produced by a cooking unit (not shown) substantially free of grease particles and other impurities, which are trapped by the hood, outside the hood through a vent not shown, to the outside atmosphere.

The hood 1 illustrated in FIG. 1 will be described from the lower part to the top part thereof, that is by following the path 11 of cooking fumes through the exhaust hood until they exit therefrom in substantially purified form to be led to the atmosphere.

At the entrance to the exhaust hood 1 there is an element 13 which is folded at 15 and which is made of a horizontal rectangular first flat member 17 and an upwardly inclined second flat member 19. Rectangular flat member 15 is fixed in known manner, such as by soldering, against the inner face 21 of vertical wall 5 at 23. It is also fixed in a similar manner (not shown) against vertical back wall 3. All in all, flat member 17 is fixed as indicated in a manner to be substantially horizontal by projecting generally perpendicularly from both walls 3 and 5. The flat member 17 has a hole 25 formed therein which opens into a drain 27 schematically illustrated partly in dotted lines in FIG. 1. In FIG. 2, which illustrates a combination of two exhaust hoods mounted side by side, drain 27 is used for both of them. As designed in accordance with FIGS. 1 and 2, flat member 17 constitutes a lower collector for grease particles and impurities which are thereafter drained away from the hood through drain 27.

Turning now to upwardly inclined flat member 19, first, it will be seen to be associated with flat member or lower collector 17 at joint 15. In other words, flat member 19 is a continuation of flat member 17 but which abruptly changes direction at 15 by being suddenly upwardly inclined to constitute an inlet deflector. In the illustrated embodiment, deflector 19 forms an angle $\alpha$ of approximately 135° with lower collector 17, it being understood that this angle may vary to some extent depending on design and purposes intended to be achieved, the chosen values being of course left to the skilled artisan.

As shown, inlet deflector 19 extends upwardly a certain distance above the level of lower collector 17 and at least high enough to provide a first swirling at a to the path 11 of cooking fumes ascending into the illustrated exhaust hood 1. In the illustrated embodiment, the top of inlet deflector 19 is located above the level of grease particles and impurities collector 29 which will be described herein below. For convenience and ease in providing a smooth swirling a, the upper edge of inlet deflector 19 in inwardly shaped into a double flange 31, although any other type of arrangement of the outer edge which will achieve the intended purpose could be used as is well known to those skilled in the art.

Turning now to the next level of the illustrated exhaust hood 1, the latter will be seen to comprise a combination grease particles and impurities intermediate collector 33 and a downwardly inclined internal deflector 35, the latter being upwardly spaced from inlet deflector 19. Although inlet deflector 19 and internal deflector 35 are generally similarly inclined, the former is qualified as upwardly inclined and the latter downwardly inclined. The reason is that path 11 of cooking fumes upwardly follows the deflecting face of inlet deflector 19 while it downwardly follows the deflecting face of internal deflector 35.

Figure 2:
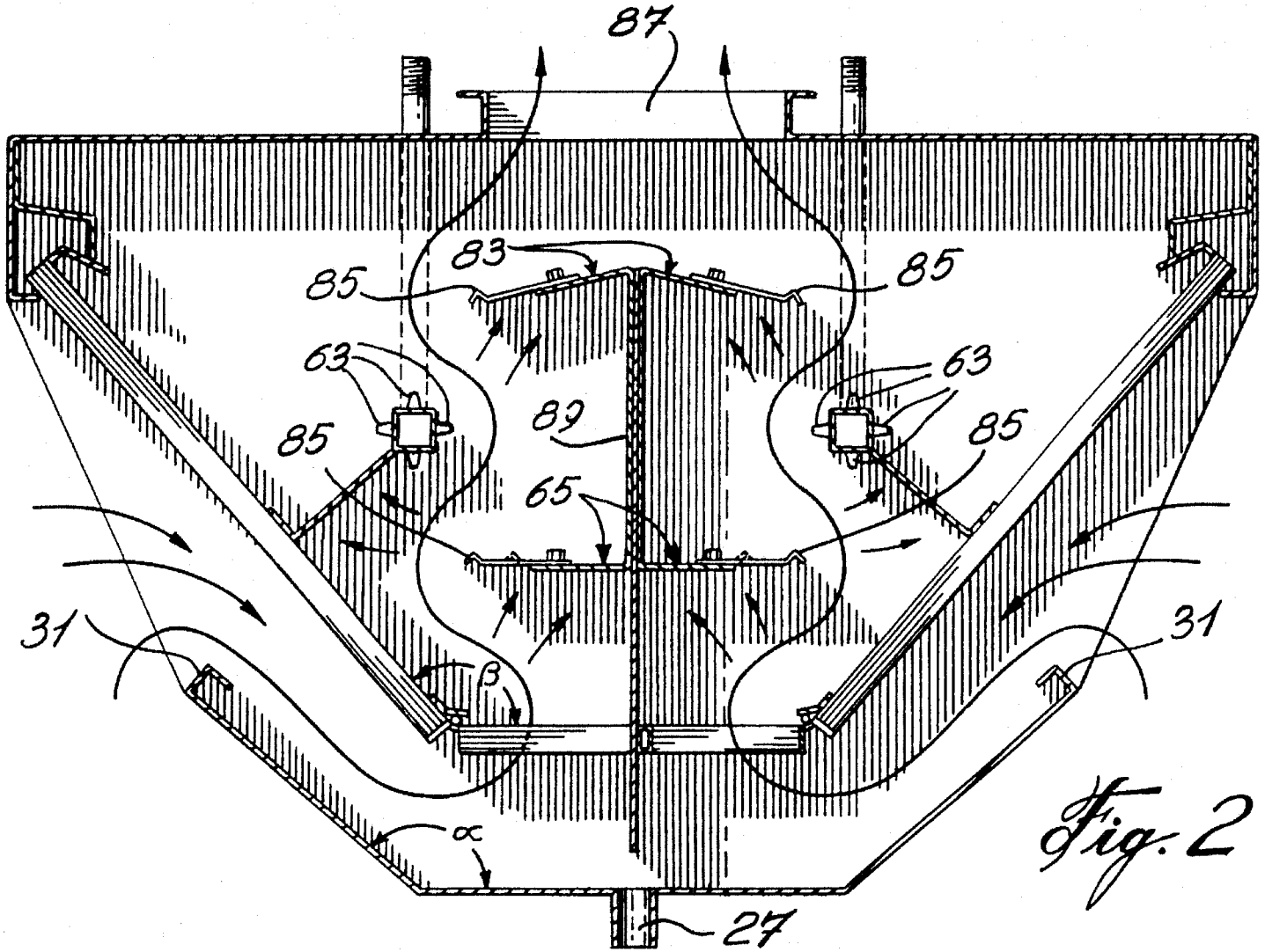
FIG. 2 is a vertical cross-section view of a twin exhaust hood according to the invention.

Turning now to intermediate collector 33, the latter appears as a rectangular member which is perpendicularly fixed such as by soldering or any other means known to those skilled in the art against lateral wall 5 at 35 and back wall 3 (not illustrated in FIG. 1). A path opening 39, rectangular in FIG. 1, is formed in the intermediate collector 33 to allow for the upward passage of the path of cooking fumes while swirling upwardly at b at the lower extremity of intermediate deflector 35. The opening extends here from lateral wall 5 to the outer limit of the collector 33.

Intermediate deflector 35 is in the form of a rectangular plate which is united with intermediate collector 33 at fold 41. It forms an angle β with collector 33 which is substantially equal to angle α, i.e. about 135°. As is the case with angle α, the value of angle β could vary to some extent depending on design and the choice of one skilled in the art. At the top, internal deflector 35 is fixed to horizontal top wall in the manner illustrated in FIG. 1 although any other means depending on the choice of one skilled in the art would also be acceptable. In the illustrated version, the upper extremity 43 rests in a flange 45 formed in a holding band 47 downwardly projecting from horizontal top wall 9. Finally, a removable door 49 is mounted in known manner in internal deflector 35. This door is intended to permit access inside the hood for cleaning or servicing it. For convenience, the lower end of the door has a gripping means 51 serving to slide it down and out of internal deflector 35.

Referring again to FIG. 1, particularly to the internal deflector 35, it will be noted that a transverse plate 55 is mounted on the non deflecting upper face and perpendicularly thereto as illustrated. At its inner end the transverse plate 55 is terminated by a flange 57 through which it is fixed to internal deflector 35, such as by soldering although any other fixing means would be acceptable. At the outer edge of the transverse plate 55, there is a manifold 59 of rectangular cross-section. The manifold is mounted through a corner 61 thereof. The manifold has cleaning jets 63 distributed in known manner on all four faces, so as to remove grease particles and impurities accumulated generally in hood 1 and more particularly on the blades which will be described hereinafter, by projecting a cleaning fluid thereon from a source of cleaning fluid (not shown).

It will be seen that the internal deflector will cause the path 11 of cooking fumes to descend therealong and to swirl upwardly at b while passing through opening 39. Then, the path 11 of cooking fumes will move upwardly in the direction of transverse plate 55.

Before doing so, however, the path 11 of cooking fumes will hit a first forwardly adjustable blade means 65, which is disposed against lateral wall 5 to project perpendicularly thereto at a level above the top of inlet deflector 19 but below transverse plate 55.

As shown, the forwardly adjustable blade means 65 consists of a fixed panel 67 which is secured in known manner, such as by soldering against lateral and back walls 5, 3 and an adjustable panel 69 which is mounted on fixed panel 67 between a retracted position (not shown) and the extended position illustrated in the drawings. To achieve this purpose, bolts and nuts 71,73 (two pair for each) are provided for fixed panel 67. The adjustable panel 69 on the other hand has two longitudinal channels 75,77 provided transversely near both ends thereof. With each channel 75,77 there are a plurality of finger like recesses 79 which are perpendicular to the channels and are all disposed on the same side of channels 75,77. Bolts 71 are disposed in selected recesses 79 depending on the desired forward extent of the forward edge is 81 of the adjustable panel 69. It is thus possible to facilitate a displacement of the adjustable panel 69 merely by engaging bolts and nuts 71,73 in selected recesses 79.

It will be seen that another blade means 83, similar to blade means 65 is provided against lateral wall 5 above the level of manifold 59. The only difference is that this blade means 83 is somewhat downwardly inclined to achieve a better catch of grease particles and impurities. It will be noted that both adjustable panels are terminated by a gable end 85 to provide a better removal of undesirable elements.

Thus, after having traveled through opening 39, under the suction force of the fan, path 11 will hit blade means 65 which, with transverse plate 55, will achieve swirl c while retaining grease particles and impurities against the underfaces of blade means 65 and transverse plate 55. Blade means 83 will produce a final swirl d causing the path to curve around gable end 85 into opening 87 formed in top wall 9 and then into outside air.

This arrangement enables to treat all kinds of flow rates and volumes of cooking fumes by adjusting the speed of the fan and the forward extension of the blade means so as to maintain a constant static pressure in the flow being directed towards the outlet.

The embodiment illustrated in FIG. 2 consists of two hoods identical to that illustrated in FIG. 1 but mounted side by side, through a common lateral wall 89. They also have drain 27 and opening 87 in common.

It is also within the spirit of the present invention to provide at any time, a series of blades disposed side by side and if necessary at different forward adjustments, inside the same hood or grease extractor. It is then possible to match the extraction capacity of the hood with different cooking equipments of a cooking line-up.

I claim:

1. An exhaust hood adapted for separating grease particles and impurities contained in cooking fumes which are produced when cooking over a cooking unit, wherein said cooking fumes are directed towards said hood, said hood including vertical back, lateral and front walls, and a horizontal top wall, and an exhaust fan to direct fumes substantially free of grease particles and other impurities outside said hood through a vent, said hood also including means defining an upwardly directed swirling path for said cooking fumes thereby inducing centrifugal force in a flow of said cooking fumes to remove grease particles and impurities from said fumes, and a plurality of forwardly adjustable blade means disposed along said path to maintain a constant static pressure therein and accentuate or decrease the intensity of the swirling path and thereby of centrifugal force applied to said grease particles and impurities, depending on volume and flow rate of the cooking fumes ascending through the hood, said hood comprising an upwardly inclined inlet deflector at an entrance of said flow into said hood, a downwardly inclined internal deflector upwardly spaced from said inlet deflector, a plate-like lower grease particles and impurities collector, having an inner end fixed against said lateral wall and projecting substantially perpendicularly therefrom, said lower collector having an outer end, said upwardly inclined inlet deflector starting from said outer end of said lower grease particles and impurities collector and extending upwardly to an upward edge thereof providing a first swirling motion of said path, a drain provided in said lower collector to drain away grease particles and impurities accumulated thereon, a rectangular intermediate grease particles and impurities collector mounted on said lateral wall and projecting perpendicularly therefrom to an outer limit thereof, a path opening formed in said intermediate collector to permit grease particles accumulated thereon to drop onto said lower grease particles and impurities collector and enabling said flow path to pass upwardly while swirling around a lower extremity of said intermediate deflector, the lower extremity of said internal deflector being fixed to the outer limit of said intermediate grease particles and impurities collector and the upper extremity of said internal deflector being mounted at said horizontal top wall, thereby permitting said removed grease particles and impurities to drop in counter-current to said upwardly directed swirling path to be collected in lower part of said hood.

2. A cooking hood according to claim 1, which comprises a transverse plate mounted on said internal deflector and extending therefrom into said path to arrest grease particles and impurities and to impart additional swirling movement of said path around an outer edge of said transverse plate.

3. A exhaust hood according to claim 2, which comprises a manifold provided at said outer edge of said transverse plate, said manifold having cleaning jets mounted thereon to remove grease particles and impurities remaining accumulated on said blades, transverse plate and deflectors, by projecting a cleaning fluid thereon.

4. An exhaust hood according to claim 3, wherein said manifold has a rectangular cross-section and is mounted at the outer edge of said transverse plate through a corner of said manifold.

5. An exhaust hood according to claim 2, wherein said transverse plate is formed with a longitudinal flange at the inner edge thereof, said plate is mounted on said internal deflector through said flange.

6. An exhaust hood according to claim 5, wherein said transverse plate is mounted at right angle with respect to said internal deflector.

7. An exhaust hood according to claim 1, wherein said path opening formed in said intermediate collector extends from said lateral wall to said outer limit.

8. An exhaust hood according to claim 7, which comprises a removable door mounted in said internal deflector, to permit access inside said hood for cleaning or servicing same.

9. An exhaust hood adapted for separating grease particles and impurities contained in cooking fumes which are produced when cooking over a cooking unit, wherein said cooking fumes are directed towards said hood, said hood including vertical back, lateral and front walls, and a horizontal top wall, and an exhaust fan to direct fumes substantially free of grease particles and other impurities outside said hood through a vent, said hood also including means defining an upwardly directed swirling path for said cooking fumes thereby inducing centrifugal force in a flow of said cooking fumes to remove grease particles and impurities from said fumes, and a plurality of forwardly adjustable blade means disposed along said path to maintain a constant static pressure therein and accentuate or decrease the intensity of the swirling path and thereby of centrifugal force applied to said grease particles and impurities, depending on volume and flow rate of the cooking fumes ascending through the hood, said hood comprising an upwardly inclined inlet deflector at an entrance of said flow into said hood, a downwardly inclined internal deflector upwardly spaced from said inlet deflector, a transverse plate mounted on said internal deflector and extending therefrom into said path to arrest grease particles and impurities and to impart additional swirling movement of said path around an outer edge of said transverse plate, a lower forwardly adjustable blade means disposed below said transverse plate and an upper forwardly adjustable blade means above said transverse plate.

10. An exhaust hood according to claim 9, wherein said forwardly adjustable blade means are each formed of a fixed panel secured to said lateral wall, and an adjustable panel mounted on said fixed panel between a retracted and an extended position.

11. An exhaust hood according to claim 10, wherein said lower blade means is mounted substantially horizontally and said upper blade means is downwardly inclined.

12. An exhaust hood according to claim 10, wherein bolts and nuts are provided with said fixed panels, said adjustable panel having longitudinal channels provided transversely with respect to said fixed panels and a plurality of finger like recesses perpendicular to said channels and all disposed on the same side of said channels, said bolts being disposed in selected recesses depending on desired forward extent of forward edge of said adjustable panel, thereby facilitating a displacement of said adjustable panels by engaging the bolts in selected recesses.

* * * * *